US007181020B1

(12) United States Patent
Riley

(10) Patent No.: US 7,181,020 B1
(45) Date of Patent: Feb. 20, 2007

(54) AUDIO FEEDBACK REGARDING AIRCRAFT OPERATION

(75) Inventor: Victor Andrew Riley, Shoreview, MN (US)

(73) Assignee: Honeywell International, Inc., Morristown, NJ (US)

( * ) Notice: Subject to any disclaimer, the term of this patent is extended or adjusted under 35 U.S.C. 154(b) by 861 days.

(21) Appl. No.: 09/644,752

(22) Filed: Aug. 23, 2000

(51) Int. Cl.
*H04R 29/00* (2006.01)

(52) U.S. Cl. ..... 381/56; 340/952; 340/971; 244/194

(58) Field of Classification Search ..... 381/56; 244/1 N, 1 R, 75 R, 76 R, 194; 340/945, 340/971, 952; 701/1, 3, 14, 29
See application file for complete search history.

(56) References Cited

U.S. PATENT DOCUMENTS

| | | | | |
|---|---|---|---|---|
| 2,748,372 | A | 5/1956 | Bunds | |
| 4,538,777 | A | 9/1985 | Hall | |
| 4,831,438 | A * | 5/1989 | Bellman et al. | 348/148 |
| 4,941,187 | A * | 7/1990 | Slater | 381/86 |
| 4,952,931 | A | 8/1990 | Sergeldin et al. | 340/902 |
| 5,228,093 | A | 7/1993 | Agnello | |
| 5,309,379 | A | 5/1994 | Rawlings | |
| 5,355,416 | A | 10/1994 | Sacks | |
| 5,406,487 | A * | 4/1995 | Tanis | 701/16 |
| 5,692,702 | A * | 12/1997 | Andersson | 244/1 N |
| 5,798,458 | A * | 8/1998 | Monroe | 73/587 |
| 5,864,820 | A | 1/1999 | Case | |
| 5,894,285 | A | 4/1999 | Yee | |
| 6,012,426 | A | 1/2000 | Blommer | |
| 6,273,371 | B1 * | 8/2001 | Testi | 244/223 |
| 6,275,590 | B1 * | 8/2001 | Prus | 381/61 |
| 6,366,311 | B1 * | 4/2002 | Monroe | 348/148 |
| 6,453,273 | B1 * | 9/2002 | Qian et al. | 702/190 |
| 6,545,601 | B1 * | 4/2003 | Monroe | 340/521 |

FOREIGN PATENT DOCUMENTS

| | | | |
|---|---|---|---|
| DE | 3327076 | A | 1/1985 |
| GB | 2256996 | A | 12/1992 |
| GB | 2314542 | A | 1/1998 |

OTHER PUBLICATIONS

"Basics About MPEG Perceptual Audio Coding", http://www.iis.fhg.de/amm/techinf/basics.html, 3 p., (1998-2000).

(Continued)

*Primary Examiner*—Brian T. Pendleton
(74) *Attorney, Agent, or Firm*—Ingrassia Fisher & Lorenz

(57) ABSTRACT

A method, system, and apparatus, for providing audio feedback regarding the operation of an aircraft. In one aspect, microphones are placed next to sound sources, which could be components of the aircraft. Audio inputs are received from the microphone and analyzed based on a psychoacoustic model to provide settings, such as level, pan, and equalization, to an automatic mixer. The automatic mixer mixes the sounds based on the settings and provides audio output to the pilot of the aircraft. The pilot can then use the audio output to more effectively monitor the operations of the aircraft components, which might otherwise be difficult or impossible to hear.

31 Claims, 3 Drawing Sheets

OTHER PUBLICATIONS

"MPEG Audio Layer-3", http://www.iis.fhg.de/amm/techinf/layer3/index.html, 4 p., (1998-2000).

"NTSB is Pondering Whether to Recommend a Small Video Recorder in Cockpits", *The Weekly of Business Aviation*, 69 (2), p. 13, (Jul. 12, 1999).

"NTSB Recommends Video For government Aircraft Without FDR's", *Aviation Daily*, 339 (29), p. 5, (Feb. 11, 2000).

"Overview of the MP3 Techniques", http://www.mp3-tech.org/tech.html, 2 p., (1997-2000).

* cited by examiner

AUDIO FEEDBACK REGARDING AIRCRAFT OPERATION

FIELD OF THE INVENTION

This invention relates generally to aircraft and more particularly to providing audio feedback regarding the operation of an aircraft.

BACKGROUND OF THE INVENTION

Aircraft have seen enormous advances in technology over the last century. For example, in just the recent past, aircraft engines, pumps, and other actuators have become quieter, autopilots have become smoother, and automation has taken a greater role in aircraft control. But, these technological advances have also resulted in pilots becoming increasingly removed from the direct control of the aircraft. Further, these advances have resulted in pilots having less direct feedback about the operation of the aircraft systems and flight control actions.

An example of less feedback is the throttle lever on the Airbus A320 aircraft, which remains in a fixed position while the autothrottle system is issuing throttle commands to the engines. Thus, the only indication the pilots have of the actions of the autothrottle system is the movement of the N1 engine indicator, which shows the turbine engine rotation speed.

Further, noise from air flow over the cockpit prevents the crew from hearing the engines, and the autopilot and autothrottle systems are smooth enough, so that it is often difficult for the pilot to detect aircraft maneuvers.

Without a system that gives better feedback to the pilots, all of the above factors can combine to cause pilots to lose track of the operation of the aircraft's automated systems with potentially disastrous results.

SUMMARY OF THE INVENTION

The present invention provides solutions to the above-described shortcomings in conventional approaches, as well as other advantages apparent from the description below.

The present invention is a method, system, and apparatus for providing audio feedback regarding the operation of an aircraft. In one aspect, microphones are placed next to sound sources, which could be components of the aircraft. Audio inputs are received from the microphones and analyzed based on a psycho-acoustic model to provide settings, such as level, pan, and equalization, to an automatic mixer. The automatic mixer mixes the sounds based on the settings and provides audio output to the pilot of the aircraft. The pilot can then use the audio output to more effectively monitor the operations of the aircraft components, which might otherwise be difficult or impossible to hear.

DETAILED DESCRIPTION OF THE INVENTION

In the following detailed description of exemplary embodiments of the invention, reference is made to the accompanying drawings (where like numbers represent like elements) that form a part hereof, and in which is shown by way of illustration specific exemplary embodiments in which the invention may be practiced. These embodiments are described in sufficient detail to enable those skilled in the art to practice the invention, but other embodiments may be utilized and logical, mechanical, electrical, and other changes may be made without departing from the scope of the present invention. The following detailed description is, therefore, not to be taken in a limiting sense, and the scope of the present invention is defined only by the appended claims.

The present invention is a method, system, and apparatus, for providing audio feedback regarding the operation of an aircraft. In one aspect, microphones are placed next to sound sources, which could be components of the aircraft. Audio inputs are received from the microphones and analyzed based on a psycho-acoustic model to provide settings, such as level, pan, and equalization, to an automatic mixer. The automatic mixer mixes the sounds based on the settings and provides audio output to the pilot of the aircraft via a speaker or headphones. The purpose of the mixing functions, either automatic or manual, is to balance all of the auditory inputs, so that the pilot is able to acoustically monitor the operation of all of the sound sources simultaneously, which might otherwise be difficult or impossible to hear.

Figure 1:
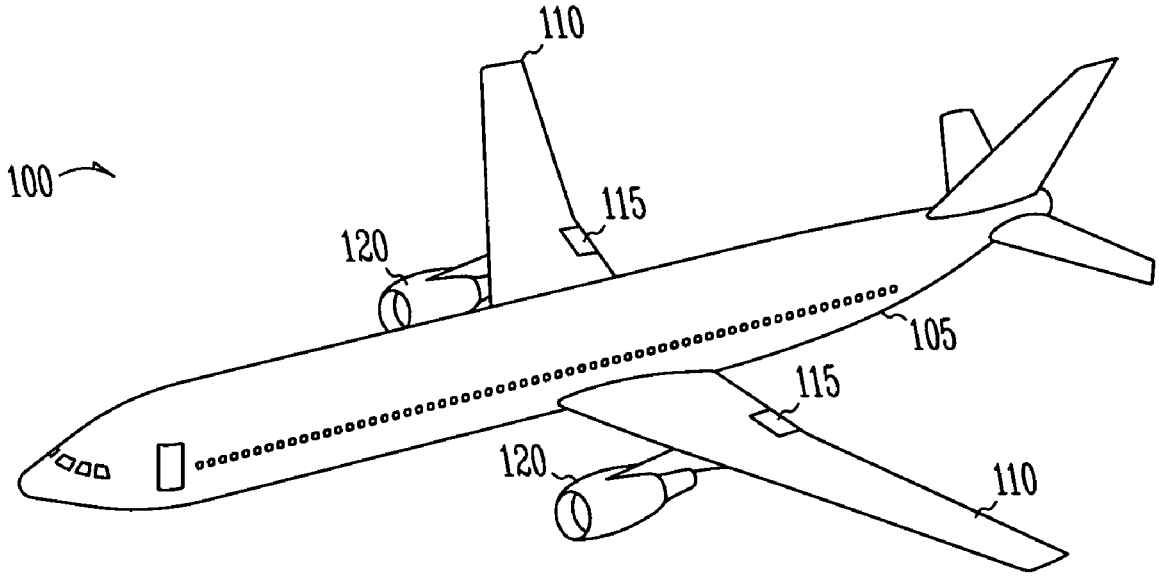
FIG. 1 depicts a pictorial representation of an aircraft in which an embodiment of the invention could be implemented.

FIG. 1 depicts a pictorial representation of an aircraft in which an embodiment of the invention could be implemented. Aircraft 100 is illustrated having airframe 105, wings 110, flaps 115, and engines 120.

Airframe 105 is that portion of aircraft 100 to which other aircraft components are affixed, either directly or indirectly. For example, wings 110 of aircraft 100 are affixed directly to airframe 105, but flaps 115 are affixed directly to wings 110 and indirectly to airframe 105 through wings 110.

The configuration depicted in FIG. 1 is but one possible embodiment, and other embodiments could have more, less, or different aircraft components. For example, although the aircraft depicted is a large passenger airplane with jet engines and fixed wings, any type of aircraft could be used including, but not limited to, a small private plane with a piston engine and a propeller, a helicopter, a transport airplane, a spaceship, or any other type of civilian or military craft that flies.

Figure 2:
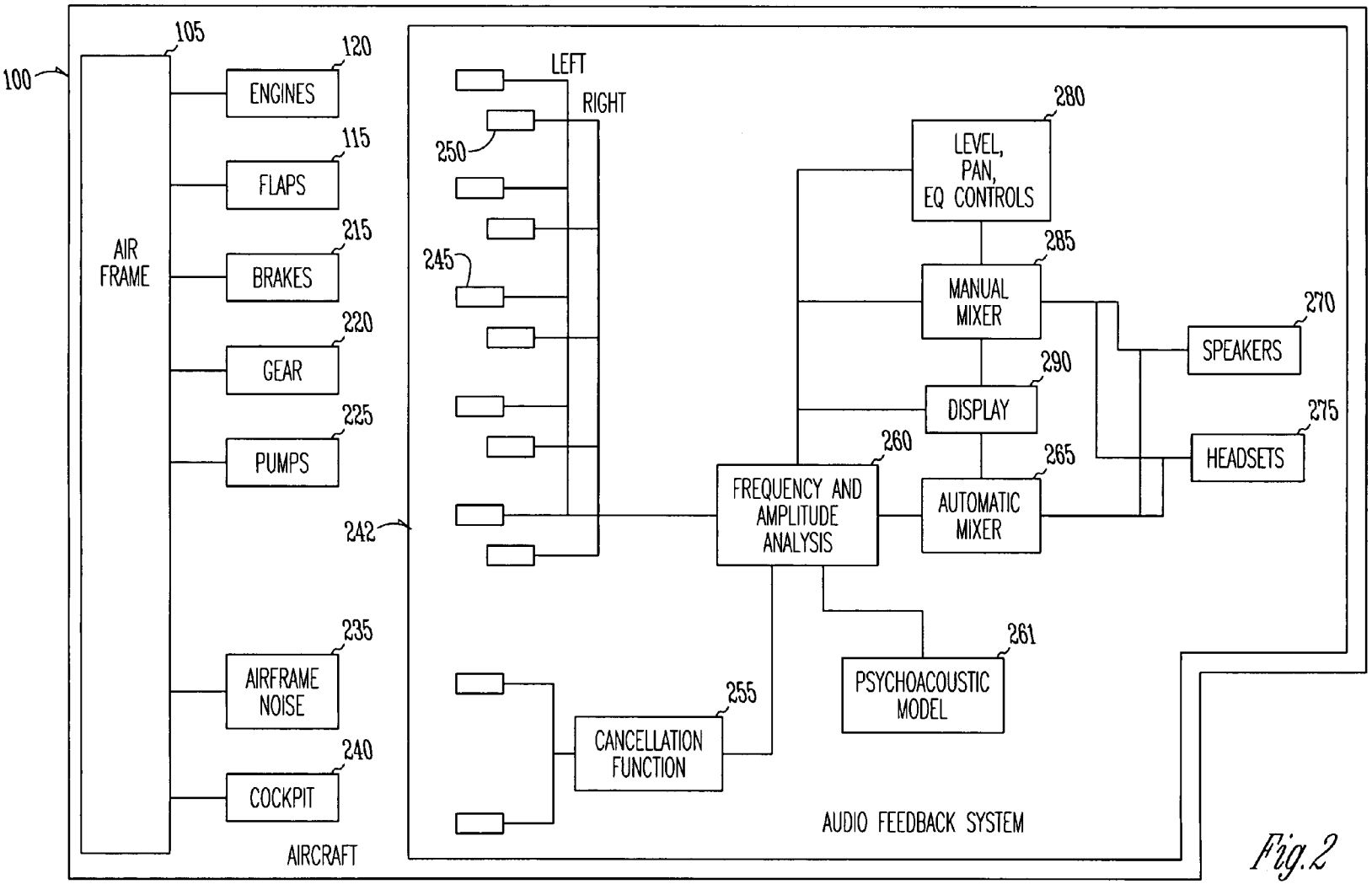
FIG. 2 depicts a block diagram of primary components of an aircraft configuration that can be used to implement an embodiment of the invention.

FIG. 2 depicts a block diagram of the primary components of aircraft 100 that can be used to implement an embodiment of the invention.

Aircraft 100 contains airframe 105 to which aircraft components are affixed, either directly or indirectly, and audio feedback system 242. Aircraft components include engines 120 (one or many), flaps 115, brakes 215, gear 220, pumps 225, and cockpit 240. Air rushing past airframe 105 produces airframe noise 235.

Audio feedback system 242 includes microphones, such as microphones 245 and 250, adjacent to the various aircraft components. Audio feedback system 242 also includes cancellation function 255, frequency and amplitude analysis system 260, psycho-acoustic model 261, automatic mixer 265, speakers 270, headsets 275, level, pan, and equalization controls 280, manual mixer 285, and display 290.

The microphones, such as left-channel microphone 245 and right-channel microphone 250, are placed near the various aircraft components in order to feed audio input signals to frequency and amplitude analysis system 260. In this example, right and left-channel microphones are illustrated for each aircraft component except for airframe noise 235 coming from airframe 105 and cockpit 240, both of which only have one microphone. But, any number of microphones per aircraft component could be used.

Analysis system 260 determines how the various audio inputs from the microphones can be best balanced so the pilot can clearly distinguish each one independently. Analysis system 260 uses psycho-acoustic model of human auditory perception 261 to predict which signals will be inaudible due to masking.

This prediction shares some similarities with the MP3 (MPEG Audio Layer-3) music compression algorithm, which analyzes the spectral content of musical signals and, based on the combinations of closely located frequencies and relative levels, determines which sounds are most likely to be masked by others. MPEG is an acronym for Moving Picture Experts Group, a working group of ISO (International Organization for Standardization). MPEG also refers to the family of digital compression standards and file formats developed by the group.

The MP3 algorithm does its analysis using a psycho-acoustic model of how sensitive the human ear is to sounds across the frequency spectrum, how close in frequency content two competing sounds are, and whether the level differences would cause the louder sound to mask the quieter one.

But, while the MP3 algorithm uses its psycho-acoustic model to discard content that it predicts to be imperceptible, analysis system 260 instead uses psycho-acoustic model 261 to identify audio signals that the pilot wouldn't hear in the present aural environment and adjust the relative levels, the spatial localization (left/right pan), and equalization of the competing signals to ensure that all the signals surpass the masking threshold. Analysis system 260 has an iterative process to reduce the level of louder signals, enhance the level of quieter signals, apply equalization to remove redundant signals in frequency ranges that compete with other signals, and pan signals to unique positions in the aural field, so the ears can localize them. The result of this process is recommended settings of level, pan, and equalization that will balance the signals to ensure that each one will be clearly audible in the presence of the others.

The level setting adjusts the volume level of the sound signal.

The pan setting adjusts apparent spatial localization of the left and right channels by adjusting level, phase, and reverberation. If a sound is emanating from the left, the left ear hears more of the direct sound than the right ear, and hears the direct sound slightly earlier than the right ear. The brain uses this difference in phase, based on the time the signal reaches each ear, to determine spatial localization. The brain also uses the higher level of direct sound perceived by the left ear and the higher proportion of reflected sound perceived by the right ear to determine spatial localization. The pan function adjusts signal levels, phase, and reverberation to emulate the acoustic properties of natural sounds, in order to localize the sound for the pilot.

The equalization setting further separates out the sound inputs in the frequency domain by selectively boosting and dampening certain frequencies. For example, the engine sounds are likely to have a low fundamental frequency and a broad spectrum, which would mask out many other sounds. But, the pilot still needs to hear the engines in order to perceive the increasing or decreasing engine thrust and to hear potentially hazardous engine vibration. Equalization dampens out the portion of engine sounds that would mask other sounds while still keeping the engine sounds that impart information about thrust and vibration. For example, engine sounds near 200 Hz are dampened because they would likely mask out sounds from other components, such as the pumps.

Analysis system 260 then provides these recommended settings to automatic mixer 265, manual mixer 285, and display 290.

Psycho-acoustic model 261 specifies a way to separate sounds from each other, and contains a list of what sound components are likely to be masked by others. Psycho-acoustic model 261 accounts for the properties that make up the sounds that we hear:

1) The audio stimulus;

2) The ear's physical capability to perceive the audio stimulus, that is, the ear's ability to distinguish frequency and amplitude and localize a sound in space in relationship to the two ears; and 3) The psychological aspects of sound perception. For example, certain sounds are easier to hear than others; certain sounds are fatiguing, especially monotonous sounds; and humans more readily perceive a changing sound over a constant sound.

Automatic mixer 265 adjusts the individual levels and pan functions and equalization based on the recommended settings from analysis system 260.

Display 290 has set of indicators that display the operations of analysis system 260, automatic mixer 265, and manual mixer 285. Display 290 shows visual indications of source inputs plus levels, panning, and equalization, as they are being applied from the automatic and manual mixers.

Besides displaying the recommended settings, display 290 also provides switching control that allows pilots to decide which of automatic mixer 265 and manual mixer 285 will drive the acoustic output (headsets 275 or speakers 270). This is because pilots may want to simply modify the settings suggested by frequency and amplitude analysis system 260 or completely bypass automatic mixer 265 and apply only manual settings via control 280. By obtaining information directly from analysis system 260 instead of from automatic mixer 265, pilots can return to the recommendations from analysis system 260 at any time (this allows pilots to recover from over-tweaking the input parameters, and finding that they simply can't balance the sounds the way they should be), or simply turn off manual mixer 285 and revert to automatic mixer 265.

Manual mixer 285 allows the pilot to override the functions of automatic mixing 265 by using level, pan, and equalization controls 280. A manual mixer typically has sliders that the user can move in order to control levels for each of the channels, but any appropriate manual mixer could be used. Although controls 280 are drawn as separate from display 290, they could be packaged together with controls 280 implemented as virtual controls on display 290, for example as virtual buttons or sliders on a touchscreen.

Speakers 270 and headsets 275 are alternative ways for the pilot to receive sound. Speakers 270 are ambient speakers while headsets or headphones 275 contain speakers next to one or both ears.

Cancellation functions 255 work by placing microphones in or near the headsets 275 and then monitoring sound coming into the microphones and constructing a sound waveform that is opposite, which reduces the incoming sound by several dB. Cancellation functions 255 use active noise cancellation technology.

Cancellation functions 255, frequency and amplitude analysis system 260, psycho-acoustic model 261, automatic mixer 265, and manual mixer 285 can be implemented using control circuitry though the use of logic gates, programmed logic devices, memory, or other hardware components. They could also use instructions executing on a computer processor.

Figure 3:
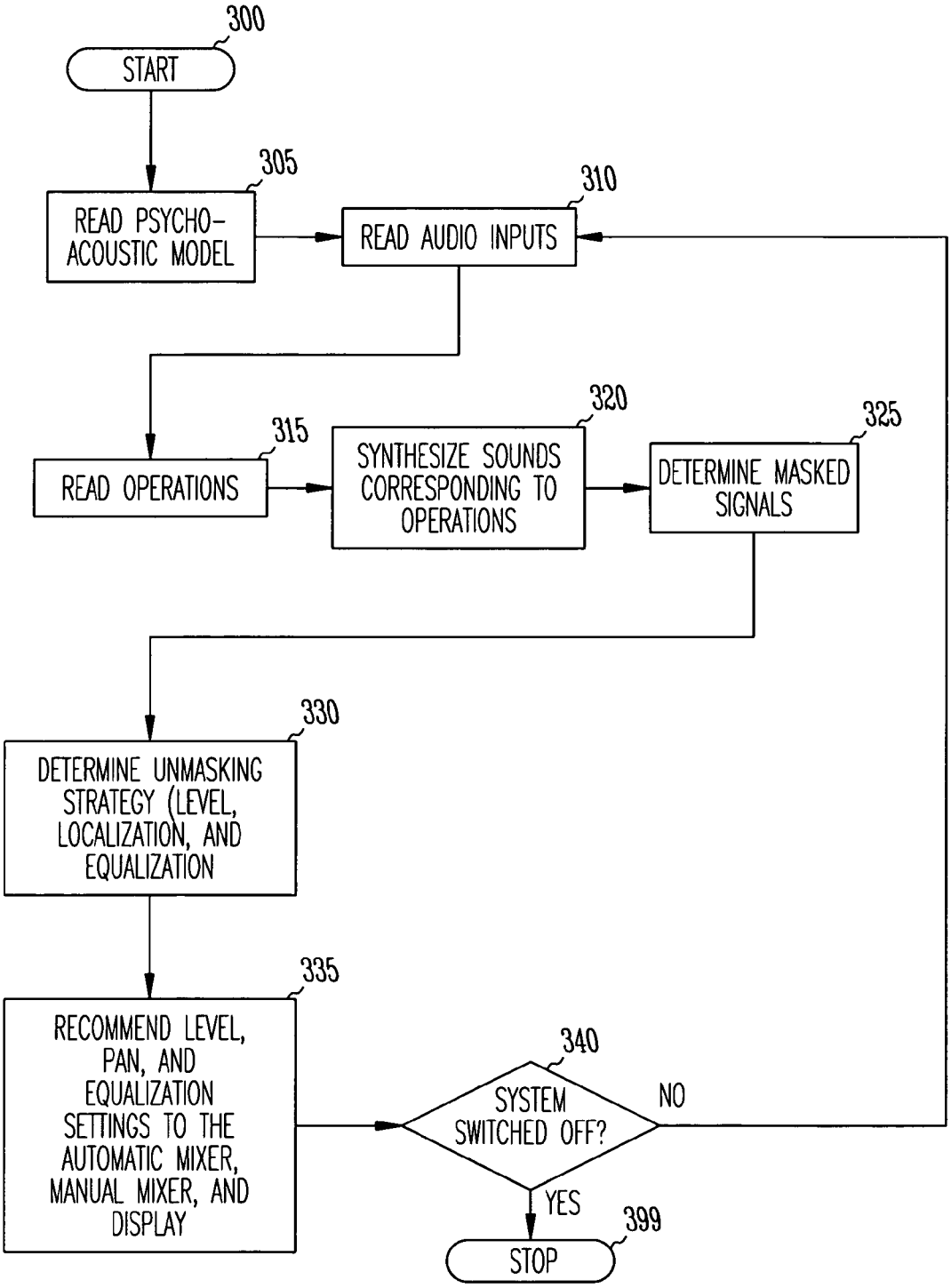
FIG. 3 depicts a flowchart of the frequency and amplitude analysis system that can be used to implement an embodiment of the present invention.

FIG. 3 depicts a flowchart of frequency and amplitude analysis system 260 that can be used to implement an embodiment of the present invention. Control beings at block 300. Control then continues to block 305 where analysis system 260 reads psycho-acoustic model 261. Control then continues to block 310 where analysis system 260 reads audio inputs from the microphones, such as microphone 245 and 250.

Control then continues to block 315 where analysis system 260 detects the aircraft operations that do not have audible sound associated with them. There are a number of components and systems on an aircraft: engines, hydraulics, bleed air used for pressurization and gauges, control functions, electrical functions, and fuel transfer functions. Some of these components, such as the engines, produce sounds that a microphone can detect. But, others do not produce audible sound, such as switches and valves opening and closing, fuel moving from one side to another, and so forth. Yet, it still would be helpful to provide the pilot with audio feedback regarding the performance of these silent systems.

Control then continues to block 320 where analysis system 260 synthesizes sounds that correspond to the silent aircraft operations that were detected in block 315. Synthesized sounds are used to augment naturally occurring sounds with automatic indications of processes that would otherwise be silent.

Control then continues to block 325 where analysis system 260 determines masked signals based on the frequency and amplitude of the audio inputs and the psycho-acoustic model, as previously described above under the description for FIG. 2.

Referring again to FIG. 3, control then continues to block 330 where analysis system 260 determines an unmasking strategy (level, localization, and equalization) based on the masked signals. The unmasking strategy determines the degrees of freedom available for each source and determines how each source should be adjusted to achieve minimal overall masking. For example, because the engines have broad frequency content, selective damping equalization can be used to unmask competing sounds without removing all of the engine information. But, a pump, which can have a very narrow frequency range, would not be a good candidate for equalized damping. If the pump has frequency components in the upper ranges that have minimal competition from other sources, those are candidates for equalized boosting, but otherwise, equalization is not a good unmasking strategy for the pump because there just isn't enough frequency content to work with.

By examining the frequency contents of all the sound sources, analysis system 260 determines which sound sources are good candidates for selective frequency damping, which are good candidates for selective frequency boosting, which are candidates for overall level adjustments only, and which ones, because they have similar fundamental frequencies but different harmonic content, are good candidates for being well separated by selective panning. Analysis system 260 then adjusts the relative levels, equalization, and pan settings to optimally bring all of the sound sources to the acoustic surface.

Control then continues to block 335 where analysis system 260 provides recommended settings of level, pan, and equalization to automatic mixer 265, manual mixer 285, and display 290 based on the unmasking strategy, as previously described above.

Referring again to FIG. 3, control then continues to block 340 where analysis system 360 determines whether audio feedback system 242 has been switched off. If the determination at block 340 is true, then control continues to block 399 where the process stops. If the determination at block 340 is false, then control returns to block 310 where analysis system 260 reads some more audio inputs, as previously described above.

CONCLUSION

The present invention provides audio feedback regarding the operation of an aircraft to a pilot. Microphones are placed next to sound sources, which are components of the aircraft. Audio inputs are received from the microphones and analyzed based on a psycho-acoustic model to provide settings, such as level, pan, and equalization, to an automatic mixer. The automatic mixer mixes the sounds based on the settings and provides audio output to the pilot of the aircraft via a speaker or headphones. The purpose of the mixing functions, either automatic or manual, is to balance all of the auditory inputs, so that the pilot is able to acoustically monitor the operation of all of the sound sources simultaneously, which might otherwise be difficult or impossible to hear.

What is claimed is:

1. A method for providing audio feedback regarding the operation of an aircraft, comprising:

receiving audio inputs from a plurality of microphones, wherein the plurality of microphones are disposed adjacent to at least one aircraft component, wherein the at least one aircraft component is a sound source;

detecting an aircraft operation that does not have an audible sound associated therewith;

adding synthesized sounds to the audio inputs that correspond to the detected aircraft operation;

mixing the audio inputs; and providing an audio output to a speaker in response to the mixing step, wherein the audio output indicates operation of the at least one aircraft component.

2. The method of claim 1, further comprising:

providing settings to the mixing step, wherein the settings are based on the audio inputs and a psycho-acoustic model.

3. The method of claim 2, further comprising:

determining masked signals based on the frequency and amplitude of the audio inputs and the psycho-acoustic model;

determining an unmasking strategy based on the masked signals; and providing the settings based on the unmasking strategy.

4. The method of claim 1, wherein the speaker is an ambient speaker.

5. The method of claim 1, wherein the speaker is contained in a headset.

6. The method of claim 2, wherein the settings comprise:

at least one of level, pan, and equalization settings.

7. The method of claim 1, wherein the mixing step is accomplished via an automatic mixer, and further comprising:

overriding the automatic mixer with a manual mixer, wherein the manual mixer comprises at least one of a level, pan, and equalization control inputs.

8. The method of claim 1, wherein microphones are placed on multiple elements selected from the group consisting of:

an airframe, an engine, a flap, a brake, a gear, a pump, and a cockpit.

9. The method of claim 1, wherein the detected aircraft operation comprises at least one of:

a hydraulic operation, an electrical system operation, an aircraft control operation, and a fuel transfer operation.

10. The method of claim 1, further comprising:

canceling noise from the audio inputs.

11. An aircraft, comprising:

an airframe;

at least one aircraft component coupled to the airframe; and an audio feedback system, comprising:

a plurality of microphones disposed adjacent to the at least one aircraft component, an analysis system that:

receives audio inputs from the microphones, detects an aircraft operation that does not have an audible sound associated therewith, adds synthesized sounds to the audio inputs that correspond to the detected aircraft operation, and provides settings to an automatic mixer that mixes the audio inputs, wherein the recommended settings are based on the audio inputs and a psycho-acoustic model.

12. The aircraft of claim 11, wherein the analysis system further:

determines masked signals based on the frequency and amplitude of the audio inputs and the psycho-acoustic model;

determines an unmasking strategy based on the masked signals; and provides the settings to the automatic mixer based on the unmasking strategy.

13. The aircraft of claim 11, wherein the automatic mixer:

mixes the audio inputs based on the settings; and provides the mixed audio inputs to a speaker.

14. The aircraft of claim 13, wherein the speaker is an ambient speaker.

15. The aircraft of claim 13, wherein the speaker is contained in a headset.

16. The aircraft of claim 11, wherein the settings comprise:

at least one of level, pan, and equalization settings.

17. The aircraft of claim 11, wherein the audio feedback system further comprises:

a manual mixer comprising level, pan, and equalization control inputs, wherein the manual mixer overrides the automatic mixer.

18. The aircraft of claim 11, wherein the aircraft component is one of:

the airframe, an engine, a flap, a brake, a gear, a pump, and a cockpit.

19. The aircraft of claim 11, wherein the aircraft component is coupled directly to the airframe.

20. The aircraft of claim 11, wherein the aircraft component is coupled indirectly to the airframe.

21. The aircraft of claim 11 wherein the detected aircraft operation comprises at least one of:

a hydraulic operation, an electrical system operation, an aircraft control operation, and a fuel transfer operation.

22. An audio feedback system, comprising:

at least one microphone for receiving sounds from at least one sound source; and an analysis system that:

receives audio inputs from the microphone, detects aircraft operations that do not have an audible sound associated therewith, adds synthesized sounds to the audio inputs that correspond to the detected aircraft operations, and provides settings to an automatic mixer that mixes the audio inputs, wherein the recommended settings are based on the audio inputs and a psycho-acoustic model.

23. The audio feedback system of claim 22, wherein the analysis system further:

determines masked signals based on the frequency and amplitude of the audio inputs and the psycho-acoustic model;

determines an unmasking strategy based on the masked signals; and provides the settings to the automatic mixer based on the unmasking strategy.

24. The audio feedback system of claim 23, wherein the automatic mixer:

mixes the audio inputs based on the settings; and provides the mixed audio inputs to a speaker.

25. The audio feedback system of claim 24, wherein the speaker is an ambient speaker.

26. The audio feedback system of claim 24, wherein the speaker is contained in a headset.

27. The audio feedback system of claim 22, wherein the settings comprise:

at least one of level, pan, and equalization settings.

28. The audio feedback system of claim 23 further comprising:

a manual mixer comprising level, pan, and equalization control inputs, wherein the manual mixer overrides the automatic mixer.

29. The audio feedback system of claim 23, wherein the sound source is at least one aircraft component.

30. The audio feedback system of claim 29, wherein the aircraft component is at least one of:

an airframe, an engine, a flap, a brake, a gear, a pump, and a cockpit.

31. The audio feedback system of claim 22 wherein the detected aircraft operations comprise at least one of:

hydraulic operations, electrical system operations, aircraft control operations, and fuel transfer operations.

* * * * *